United States Patent [19]

Harlow et al.

[11] 4,448,357

[45] May 15, 1984

[54] ROTARY MACERATOR

[75] Inventors: Stanley D. Harlow, Willowbrook; Donald Alexander, Plainfield, both of Ill.

[73] Assignee: International Harvester Co., Chicago, Ill.

[21] Appl. No.: 355,794

[22] Filed: Mar. 8, 1982

[51] Int. Cl.[3] ..... B02C 4/32

[52] U.S. Cl. ..... 241/32; 241/85; 241/86.2; 241/91; 241/228; 241/232

[58] Field of Search ..... 241/32, 228, 230, 231, 241/232, 233, 234, 84.2, 85, 89.3, 91, 121, 86.2, 122, 37; 100/37

[56] References Cited

U.S. PATENT DOCUMENTS

| | | | |
|---|---|---|---|
| 1,736,394 | 11/1929 | Dierker | 241/228 X |
| 2,097,906 | 11/1937 | Wettlaufer | 241/32 X |
| 2,144,185 | 1/1939 | Hamblin | 241/232 X |
| 2,579,767 | 12/1951 | Strawn | 241/32 |
| 2,931,363 | 4/1960 | Bulin | 241/32 X |
| 3,114,309 | 12/1963 | Haug | 100/37 |
| 3,165,133 | 1/1965 | Karlsson et al. | 241/32 |
| 3,184,171 | 5/1965 | Daman | 241/228 X |
| 3,838,823 | 10/1974 | Lewis | 241/32 |
| 4,185,786 | 1/1980 | Kline | 241/85 |

*Primary Examiner*—Mark Rosenbaum

*Attorney, Agent, or Firm*—Ernest E. Helms; F. David AuBuchon

[57] ABSTRACT

An improved macerator adapted to shred crop material and having an annular perforated die ring and a roller operative within the die ring to extrude crop material through the perforations as the die ring and roller are power-rotated. The roller is journalled on a pivotable arm which is interconnected with the macerator frame by a shearable linkage permitting the roller to shift to an inoperative position if a material overload or a foreign object is encountered. A lock is automatically effective to positively retain the roller in the inoperative position until the condition can be corrected.

7 Claims, 2 Drawing Figures

ROTARY MACERATOR

FIELD OF THE INVENTION

The invention relates generally to macerators for processing crop material and more particularly to an improved macerator of the rotary die ring and roller type.

PRIOR ART

U.S. Pat. No. 4,109,448 shows a crop material macerator of the type having a rotary die ring through which material is extruded and shredded by rollers operative against the inner periphery of the die ring. The rollers are mounted in respective bearings fixed on the macerator frame. The patent is devoid of any expressed concern with foreign object ingestion or material overloading.

U.S. Pat. Nos. 3,096,035 and 2,774,544 show material cracking or crushing machines wherein the ingestion of foreign objects is taken into consideration. The machine in each patent includes springs for resiliently opposing movement of the cracking or crushing elements as foreign objects are encountered. In each case the springs serve to bias the element toward its operative position. In the '035 patent shear pins are provided to accommodate significant overloads. Shear means in a crusher are shown in U.S. Pat. No. 3,847,358 and spring-loaded rollers are shown in U.S. Pat. No. 3,114,309.

High speed rotary macerators of the type having a roller operative within a die ring are especially susceptible to damage by ingested foreign objects. Essentially, the reason is that the object cannot be readily expelled from the macerator and thus inflicts repeated damage as the object is flung about within the machine.

Since the object may be repeatedly forced between the roller and the die ring, the use of a spring-loaded roller would be unsatisfactory. More specifically, the spring would continuously urge the roller against the ring thus leaving no space between the roller and the ring through which the object could pass thereby increasing the likelihood or amount of damage. In short, spring-loaded rollers are not the answer.

SUMMARY

The invention provides an improved macerator of the type including a die ring and an internal roller wherein the effects of foreign object ingestion or material overloading are taken into account. The roller is mounted on a pivotable arm having a shearable connection with the macerator frame. The connection is shearable under a predetermined load imposed by an overload of material or by a foreign object of significant size and hardness passing between the roller and die ring. The roller moves away from the die ring to allow the object to pass with minimum damgage to the die ring, roller, or other components. In the case of an overload of material into the macerator, the releasing of the roller protects the roller and die ring bearings from overload. Unlike the prior art which might suggest spring loading the roller back into operative position, the present invention includes means for positively locking the roller in an inoperative position out of engagement with the die ring in response to the shearing of the shearable connection. This minimizes damage within the macerator.

During normal operation (i.e. no foreign object ingestion) which may generate very large forces tending to separate the roller from the die ring, the shearable connection retains the roller in the optimum operating position. Only a significant overload of material or the ingestion of a hard foreign object can cause the roller to leave its proper position for optimum extruding operation.

DESCRIPTION OF THE PREFERRED EMBODIMENT

Figure 1:
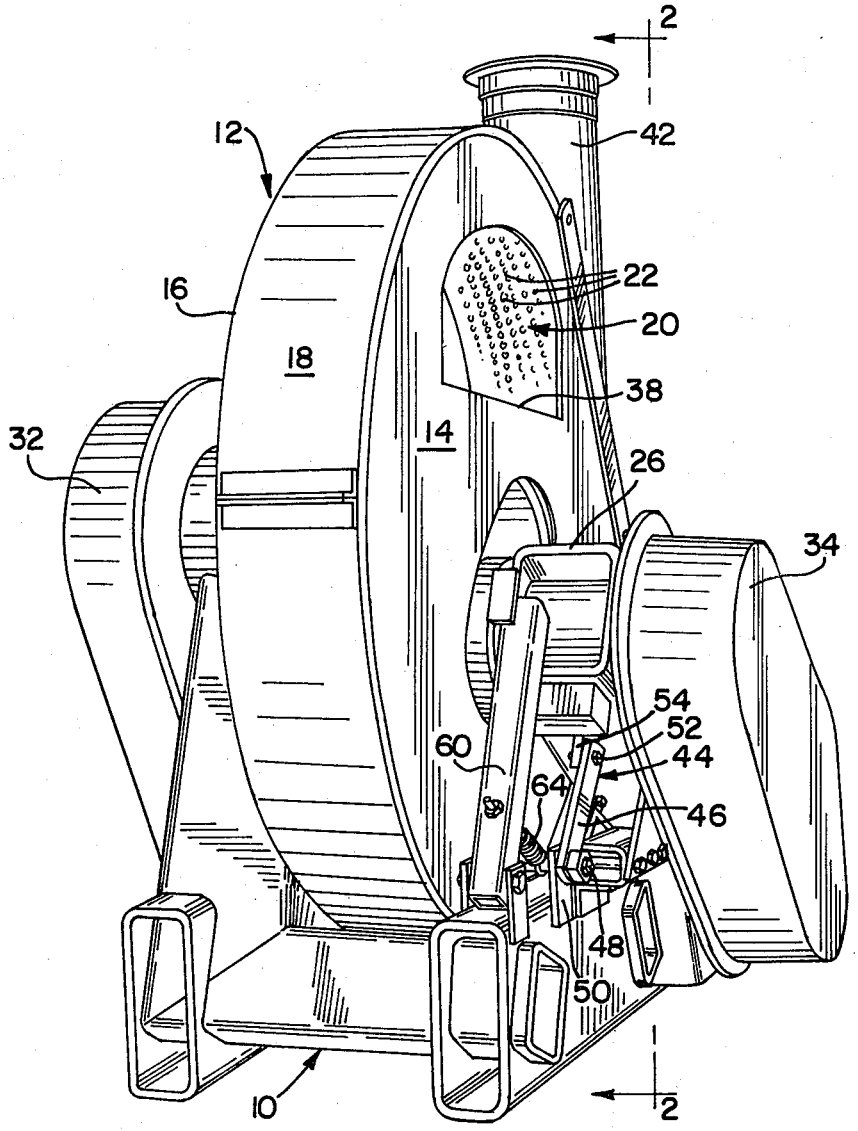
FIG. 1 is a perspective view of the macerator of the invention.
Figure 2:
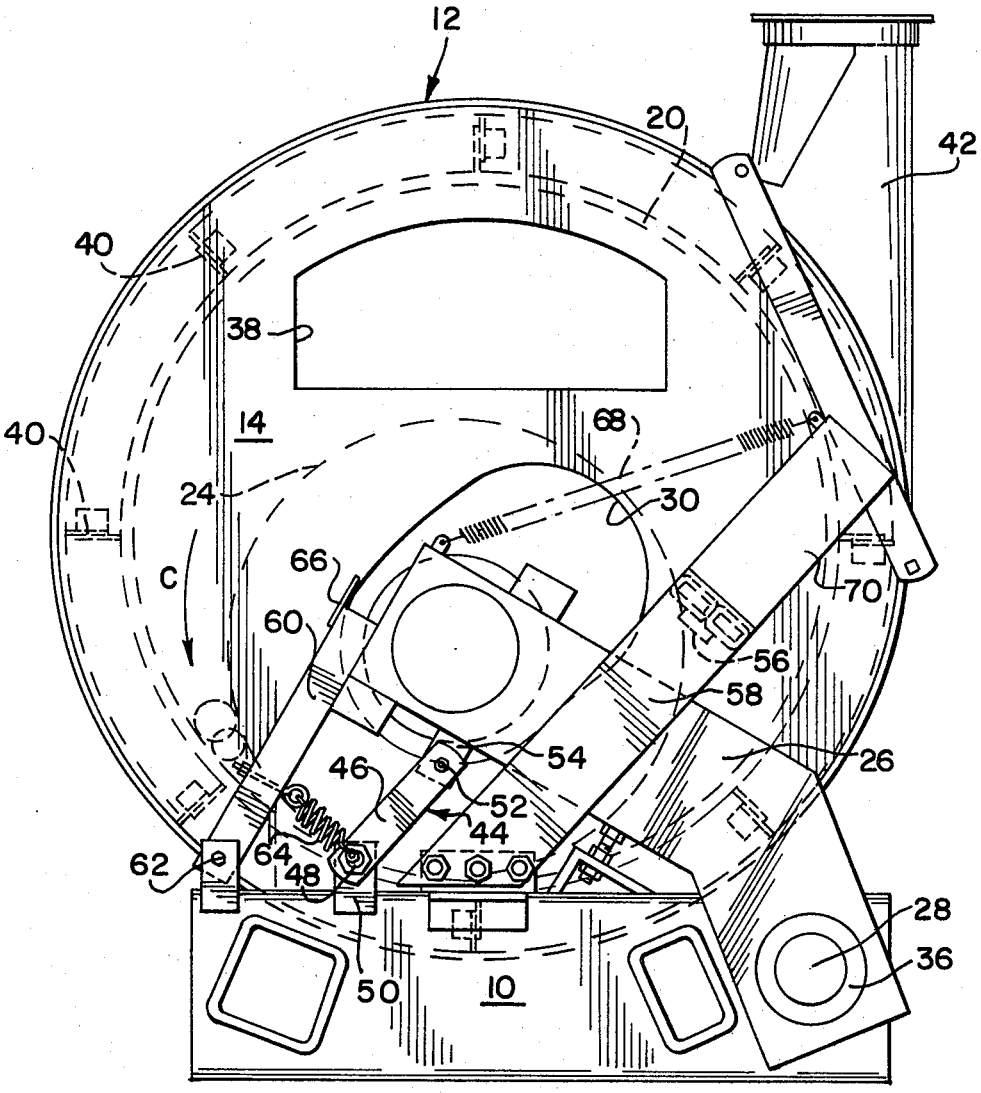
FIG. 2 is a side elevation view of the macerator of FIG. 1.

FIGS. 1 and 2 show a rotary type macerator having a unitary frame 10 on which is mounted a generally cylindrical housing 12. The housing 12 includes spaced end walls 14 and 16 and a cylindrical outer wall 18 disposed substantially around the periphery of the housing. An annular die ring 20 is journalled on the frame 10 and is disposed within the housing 12 for rotation therein. The die ring 20 includes a plurality of closely spaced openings 22 defined radially therethrough and through which the crop material is extruded and shredded.

The macerator includes a roller 24 journalled on an arm 26 which is pivotally mounted at 28 on the frame 10. The roller 24 is disposed within the housing 12 in engagement with the inner periphery of the die ring 20. A generally oval shaped opening 30 is defined through the housing wall 14 to permit the roller 24 to shift away from the die ring 20 if significant overloading is experienced. Both the die ring 20 and roller 24 are power driven at high speed by respective chain and sprocket drives 32 and 34 driven from a common input shaft 36.

A crop material inlet opening 38 is defined through the housing wall 14 and through which the material moves into the housing. The material enters the zone of converging peripheries (bight) of the die ring 20 and roller 24 in the direction of arrow C and is extruded radially outwardly through the die ring openings 22. The die ring 20 is spaced radially inwardly from the cylindrical wall 18 of the macerator housing. A plurality of impellers 40 is secured on the outer periphery of the die ring 20 in uniformly circumferentially spaced relation so as to be effective in the annular space between the die ring and cylindrical wall 18 to impell the shredded material from the macerator. A discharge tube 42 is secured on the housing and is disposed generally tangentially to the die ring 20.

In accordance with a feature of the invention the roller 24 is retained in operative position by a shearable linkage 44 connected between the arm 26 and the macerator frame 10. The linkage 44 includes an elongated member 46 having a bolted connection 48 to a support 50 welded to the frame 10. The other end of the member 46 is connected by a shear bolt 52 to a support 54 welded to the underside of the arm 26.

In the event a hard foreign object (for example, a rock in the crop material being processed) or an overload of material enters the bight between the die ring 20 and roller 24, the resulting overload causes the bolt 52 to fail in shear permitting the arm 26 to pivot upwardly to thus move the roller to an inoperative position spaced from the die ring. This minimizes damage to the macerator caused by the foreign object or protects the roller and die ring bearings due to crop material overloads. A cushioned stop member 56 mounted on a support bracket 58 is engaged by the top of the arm 26 to limit the upward movement of the arm and absorb some of the shock load caused by the rapid movement of the arm.

The macerator of the invention includes lock means for retaining the arm 26 in its raised inoperative position until the rock or other foreign object or the excess material can be removed. A bar 60 is pivotally mounted at 62 on the frame 10 and extends upwardly adjacent the end of the arm 26. A coil spring 64 is connected between the bar 60 and the bolt connection 48 to bias the bar in a clockwise direction about the pivot mount 62. A stop element 66 projects beyond the end of the bar 60.

As the arm 26 pivots upwardly as a result of an overload on the roller 24, the spring 64 pulls the bar 60 under the end of the arm 26 with the end of the arm in engagement with the stop element 66. Accordingly, the roller is maintained in a raised inoperative position to minimize rock damage and protect the bearings until the macerator is stopped and the rock or material removed.

Alternatively, the bar 60 and spring 64 can be functionally replaced by a coil spring 68 connected between the top of the roller arm 26 and an extension 70 of the bracket 58. The spring 68 exerts sufficient force to retain the roller in the raised inoperative position.

By the foregoing Applicants have provided an improved macerator particularly adapted for crop processing.

What is claimed is:

1. In a macerator having a rotary perforated die ring and a roller operative within the die ring to press material through the die ring perforations as the ring is rotated, the combination with overload release structure comprising:

means mounting said roller in a fixed rotational axis operative position and for bodily pivotal movement between fixed rotational axis operative position and inoperative position relative to said die ring;

shearable means retaining said roller in the fixed rotational axis operative position and shearable under a predetermined overload to permit the roller to swing to its inoperative position; and means operative in response to shearing of said shearable means for retaining the roller in its inoperative position thereby minimizing overload damage to the macerator.

2. A macerator adapted to shred crop material, comprising:

a frame, a generally cylindrical housing on the frame and having spaced end walls;

a perforated die ring journalled for rotation within said housing;

a roller operative on the inner periphery of said die ring to press crop material through the perforations to shred and macerate the material;

a roller support arm pivotally mounted on the frame outside said housing adjacent to one of said end walls;

means mounting said roller on said support arm so as to be pivotable therewith between fixed rotational axis operative position and inoperative position relative to the die ring;

shearable means operably connected between said support arm and said frame for retaining said roller in its fixed rotational axis operative position and being shearable under a predetermined overload on the roller to permit the roller to move to its inoperative position; and means operative in response to shearing of said shearable means for retaining the roller in its inoperative position thereby minimizing overload damage to the macerator.

3. A rotary macerator for shredding and macerating crop material, said macerator comprising:

a frame;

a generally cylindrical housing on the frame having spaced end walls and a cylindrical peripheral wall;

a crop inlet opening defined in one of said end walls;

a crop discharge opening defined in said housing cylindrical wall;

an annular die ring journalled for rotation within said housing interposed between said inlet opening and said discharge opening, said die ring including a plurality of crop macerating passages defined therethrough providing a restricted path for crop material between the inlet and discharge openings;

a roller disposed within said housing in rolling engagement with the inner periphery of said die ring to force crop material through the macerating passages in said die ring;

a roller support arm pivotally mounted on said frame outside said housing adjacent to one of said end walls and having means journalling said roller on said support arm for bodily swinging movement between fixed rotational axis crop macerating position and inoperative position relative to the die ring;

means defining an opening through the housing end wall adjacent to said support arm for accommodating swinging movement of the arm and roller relative to the housing;

means shearable under a predetermined overload on said roller permitting movement of said roller from its fixed rotational axis crop macerating position to its inoperative position; and means operative in response to shearing of said shearable means for retaining the roller in its inoperative position thereby minimizing overload damage to the macerator.

4. The macerator of claim 3, wherein said shearable means includes a linkage between said frame and said roller support arm normally retaining said roller in its fixed rotational axis crop macerating position, and a member in said linkage designed to fail in shear under the predetermined overload.

5. The macerator of claim 3, wherein said means operative in response to shearing of said shearable means for retaining the roller in its inoperative position includes a bar pivotally mounted on said frame and engageable with said roller support arm.

6. The macerator of claim 3, wherein said means operative in response to shearing of said shearable means for retaining the roller in its inoperative position includes a spring operative between said support arm and said frame.

7. The macerator of claim 3 wherein said frame has a support bracket and a cushioned stop member mounted on said support bracket, said cushioned stop member being engaged by said roller support arm in movement of said rollers to said rollers inoperative position.

* * * * *